US007070060B1

(12) United States Patent
Feider et al.

(10) Patent No.: US 7,070,060 B1
(45) Date of Patent: Jul. 4, 2006

(54) GANTRY CRANE WITH ELEVATING OPERATOR CAB

(75) Inventors: Thomas Feider, Sturgeon Bay, WI (US); Norbert Lenius, Sturgeon Bay, WI (US); Edward Lazzeroni, Racine, WI (US); Ronald Dir, Racine, WI (US); Paul J. Nykaza, Chicago, IL (US)

(73) Assignee: Mi-Jack Products, Inc., Hazel Crest, IL (US)

( * ) Notice: Subject to any disclaimer, the term of this patent is extended or adjusted under 35 U.S.C. 154(b) by 0 days.

(21) Appl. No.: 10/459,107

(22) Filed: Jun. 11, 2003

Related U.S. Application Data

(63) Continuation of application No. 10/120,264, filed on Apr. 8, 2002, now abandoned, which is a continuation of application No. 08/881,421, filed on Jun. 24, 1997, now abandoned, which is a continuation-in-part of application No. 08/451,255, filed on May 26, 1995, now Pat. No. 5,810,183.

(51) Int. Cl.
*B66C 11/02* (2006.01)

(52) U.S. Cl. ..... 212/291; 212/344

(58) Field of Classification Search ..... 212/291, 212/324, 325, 343–345; 414/460
See application file for complete search history.

(56) References Cited

U.S. PATENT DOCUMENTS

| | | | |
|---|---|---|---|
| 639,241 | A | 12/1899 | Ihlenfeldt |
| 1,698,854 | A | 1/1929 | Nagao |
| 2,529,200 | A | 11/1950 | Swanson |
| 2,761,570 | A | 9/1956 | Benson et al. |
| 3,080,981 | A | 3/1963 | Hasse et al. |
| 3,081,883 | A | 3/1963 | Minty |
| 3,146,903 | A | 9/1964 | Bjorklund |
| 3,161,309 | A | 12/1964 | Baudhuin et al. |
| 3,172,500 | A | 3/1965 | Dolphin et al. |
| 3,241,686 | A | 3/1966 | Hurst |
| 3,251,496 | A | 5/1966 | Lamer et al. |
| 3,396,858 | A | 8/1968 | Baker et al. |
| 3,396,861 | A | 8/1968 | Houlton |
| D212,876 | S | 12/1968 | Ramsden et al. |
| 3,431,016 | A | 3/1969 | Mundt-Petersen et al. |

(Continued)

FOREIGN PATENT DOCUMENTS

| | | | |
|---|---|---|---|
| DE | 906 990 | B | 3/1954 |

(Continued)

*Primary Examiner*—Thomas J Brahan
(74) *Attorney, Agent, or Firm*—Gardner Carton & Douglas LLP

(57) ABSTRACT

A gantry crane has first and second side support frames spaced by a pair of trolley beams. A load lifting mechanism is connected to the trolley beams and includes a lift frame for engaging a load to be lifted. An operator cab is mounted on the first side support frame and is vertically moveable between a lowermost position and an uppermost position in an operational plane defined by the first side support frame. A cab lift cable has a length and a first end fixed to the operator cab and a second end fixed to the side support frame. A hydraulic cylinder urges the cable between its fixed first and second ends in a direction transverse to a portion of its length. In another embodiment of the invention, an operator cab is adapted to be horizontally moveable. The elevating operator cab of the present invention can be configured to move horizontally. The elevating operator cab is lifted by a carriage beam vertically moveable along vertical legs of the first side support frame. The operator cab is moveable horizontally along the carriage beam.

20 Claims, 9 Drawing Sheets

U.S. PATENT DOCUMENTS 3,545,633 A 12/1970 Lundberg
3,558,172 A 1/1971 Lamer et al.
3,570,695 A 3/1971 Schwartz et al.
3,578,145 A 5/1971 Kuehl
3,586,183 A 6/1971 Shaffer
3,630,398 A 12/1971 Cervenak
3,675,786 A 7/1972 Wilson
3,759,409 A 9/1973 Wenzel et al.
3,785,515 A 1/1974 Shaffer
3,888,356 A 6/1975 Redelfs
3,945,503 A 3/1976 Cooper
3,957,165 A * 5/1976 Smith ..... 414/460
4,018,473 A 4/1977 Chalupsky
4,049,132 A 9/1977 Stromback
4,124,133 A 11/1978 Rosin et al.
4,128,183 A 12/1978 Finlayson
4,139,180 A * 2/1979 Itani et al. ..... 266/69
4,219,094 A 8/1980 Sturgill
4,262,777 A 4/1981 Christopher
4,279,347 A 7/1981 Appleman
4,358,020 A 11/1982 Thiele
4,378,072 A 3/1983 Appleman et al.
4,538,954 A 9/1985 Luebke
4,546,852 A * 10/1985 Martin et al. ..... 182/12
4,667,834 A 5/1987 Lanigan et al.
4,683,969 A 8/1987 Littau
4,747,745 A 5/1988 Pippen et al.
4,749,328 A 6/1988 Lanigan, Jr. et al.
4,755,100 A 7/1988 Schultz et al.
4,838,438 A 6/1989 Ishige et al.
4,858,775 A 8/1989 Crouch
4,877,365 A 10/1989 Lanigan Jr. et al.
5,092,422 A * 3/1992 Hood et al. ..... 188/329
5,154,568 A 10/1992 Conner et al.
5,199,193 A 4/1993 Akiba et al.
5,236,294 A 8/1993 Willis
5,529,452 A 6/1996 Boyles et al.

FOREIGN PATENT DOCUMENTS

DE 2 007 837 A 10/1970
FR 685503 7/1930
FR 1321271 A 3/1963
GB 153480 A 11/1920
GB 1047977 A 11/1966
GB 1236247 A 6/1971
IT 475936 5/1954
IT 648242 10/1962
JP 53-119553 AA 10/1978
JP 5-124788 AA 5/1993
NL 6700903 A 7/1968

* cited by examiner

GANTRY CRANE WITH ELEVATING OPERATOR CAB

RELATED U.S. APPLICATION DATA

This application is a continuation of U.S. application Ser. No. 10/120,264, filed Apr. 8, 2002 now abandoned which is a continuation of U.S. application Ser. No. 08/881,421, filed Jun. 24, 1997 now abandoned which is a continuation-in-part application of application Ser. No. 08/451,255 filed May 26, 1995 now U.S. Pat. No. 5,810,183.

TECHNICAL FIELD

The present invention relates generally to a gantry crane, and more particularly to a gantry crane having an elevating operator cab, and that can be optionally configured for horizontal movement while elevated.

BACKGROUND OF THE INVENTION

Gantry cranes have been used for many years for lifting and handling loads such as truck trailers, cargo containers, boats and the like. The cranes normally have a gantry structure that spans over the load(s). For example, in intermodal applications, it may span over two adjacent railroad cars or a truck trailer adjacent a railroad car. The gantry structure normally is comprised of a pair of side support frames, which are spaced by trolley beams. Each side support frame is generally comprised of two vertical legs connected at their bottom ends by a lower side beam and connected at their top ends by an upper side beam. Each side support frame defines a vertical plane.

Conventionally, a lift frame is suspended by flexible cables from the trolley beams. Spreaders, having a pair of descending arms, are located at or near each end of the lift frame. Each arm has a pivot shoe, or finger, that can engage a bottom side of a load, such as a truck trailer so that the load is engaged proximate its four corners. In some crane designs, the spreader arms can rotate to an inoperable position so that optional, specialized twist locks, can be provided on the spreader to engage a load, such as a cargo container, from the top of the container. Such a design allows intermodal operation of the gantry crane. In one mode, the crane moves loads using the spreader arms. In the other mode, the crane moves cargo containers using the twist locks.

Generally, an operator platform or an enclosed cab is provided on the gantry structure. From the platform or cab, an operator controls all of the movements of the gantry crane, i.e., the lift frame, spreader arms and the mobility of the gantry crane itself. Conventionally, the operator platform or cab is mounted either on the lower side beam of a side support frame or to one of the vertical legs.

One problem encountered by operators of gantry cranes is limited vision from the operator cab. With the operator cab in a fixed position, the operator's line of sight is also fixed. In intermodal operation, for example, the operator is unable to vary his line of sight regardless of the mode of operation or the type of load being lifted.

For instance, when a cargo container must be engaged at its top by the twist locks on the lift frame, it can be difficult for the operator, while sitting in the cab a few feet from ground-level, to properly align the twist locks with the top of the container. As a result, the operator requires more time to engage and move the container, therefore, lowering operation efficiency. In addition, the operator can damage the top of the container while attempting to properly align the twist locks with the container. Without seeing the top of the container, the operator must estimate the correct position of the twist locks and may accidently stab the container with the twist locks.

One proposed structure for allowing the operator to change his line of sight is disclosed in U.S. Pat. No. 4,877,365. Disclosed therein is a crane having a lift frame suspended from a gantry structure. The crane is provided with a first operator cab positioned near ground-level below a lower side beam of one side frame. The crane has a second operator cab positioned at an elevated position within the gantry structure. Thus, the operator can vary his line of sight by controlling the crane either from a position at ground-level or from an elevated position. This design is inconvenient, however, because the operator must leave one cab and then travel to the other cab to improve his view. Such a design also requires two sets of controls and associated wiring and instrumentation which increases costs. Finally, the design only gives the operator two vantage points, rather than allowing the operator to choose from a number of lines of sight.

The operator's limited vision from an operator cab positioned near ground-level can also cause problems when maneuvering the crane through a warehouse or railroad yard. With the cab near ground-level, it is difficult for the operator to steer the crane through stacks of containers or randomly-spaced truck trailers. As a result, the gantry crane can accidentally collide with these objects.

Another problem encountered by operators is the inability to vary horizontal lines of sight. In certain instances, an operator may have difficulty in aligning front and rear ends of the lift frame with a load to be lifted. Thus, it would be desirable for an operator to obtain a more direct view of the front and rear ends of the lift frame and load to be lifted. As discussed, however, the operator cab is normally fixed in one position on the gantry crane. Even if the operator cab was mounted for vertical movement, allowing varying vertical lines of sight, the operator would still be unable to vary horizontal lines of sight from the front end of the lift frame to the rear end of the lift frame.

Thus, there is a need for a gantry crane having an operator cab that allows an operator to vary his line of sight to efficiently engage a load either from its bottom or from its top, and also to efficiently engage a load at its front and rear ends. The present invention is provided to solve these and other problems.

SUMMARY OF THE INVENTION

The present invention provides a gantry crane having a vertically moveable operator cab. According to one aspect of the invention, a gantry crane has first and second side support frames spaced by a trolley beam. A load lifting mechanism is connected to the trolley beam and has means for engaging a load to be lifted. An operator cab is mounted on the first side support frame. The operator cab is vertically moveable between a lowermost position and an uppermost position in an operational plane defined by the first side support frame.

According to another aspect of the invention, the first side support frame is comprised of two vertical legs connected by an upper side beam and a lower side beam. The lower side beam has a downwardly-extending portion to accommodate the lowermost position of the operator cab.

According to a further aspect of the invention, a mechanism is provided for vertically moving an operator cab on a gantry structure. A cable is provided having a length and a first end fixed to the operator cab. A second end of the cable is fixed to the gantry structure. Means are provided for urging the cable between its fixed first and second ends in a direction transverse to a portion of its length.

According to yet another aspect of the invention, means are provided for preventing an access door of the operator cab from fully opening when the operator cab is raised from its lowermost position. Means are provided for preventing the spreader from being operated while the cab is being raised on the gantry crane. Means are provided for preventing the operator cab from being lowered too quickly. Means are also provided for preventing vertical movement of the operator cab when the access door is open.

According to another aspect of the invention, an operator cab is provided having opposing side walls connected by a front wall and a side wall.

According to a further aspect of the invention, an elevating operator cab is provided that can be moved horizontally as well as vertically to enhance an operator's lines of sight with respect to a load to be lifted.

In an embodiment, a gantry crane is provided which includes first and second side support frames spaced by at least one beam, a load lifting mechanism operable to support a load between said first and second side support frames, and an operator cab that is horizontally and vertically moveable in an operational plane defined by the first side support frame. In a related embodiment, the first side support frame includes at least two vertical legs, an upper side beam and a lower side beam, and the upper and lower side beams extend between the vertical legs. The operational plane may be defined by the vertical legs, upper side beam and the lower side beam.

In an embodiment, a generally horizontal carriage beam is disposed within the operational plane. The carriage beam is vertically movable within the plane, and the operator cab is movably connected to the carriage beam.

In an embodiment, the first side support frame includes at least two vertical support rails, and the carriage beam is guided vertically along the rails.

In an embodiment, a trolley is mounted to move horizontally along the carriage beam, and the operator cab is mounted to the trolley.

In an embodiment, the operator cab includes a door to provide access into an interior of the cab, and a latch that automatically prevents the door from opening when the operator cab is moved vertically from the lower most position. The latch may include a shaft rotatably mounted to an outside portion of the operator cab, the shaft having an arm on an end of the shaft such that when the shaft rotates, the arm moves to a position across the access door when the operator cab is vertically moved from the lower-most position preventing the access door from being opened.

Other advantages and aspects of the present invention will become apparent upon reading the following description of the drawings and detailed description of the invention.

DETAILED DESCRIPTION OF THE INVENTION

Figure 1:
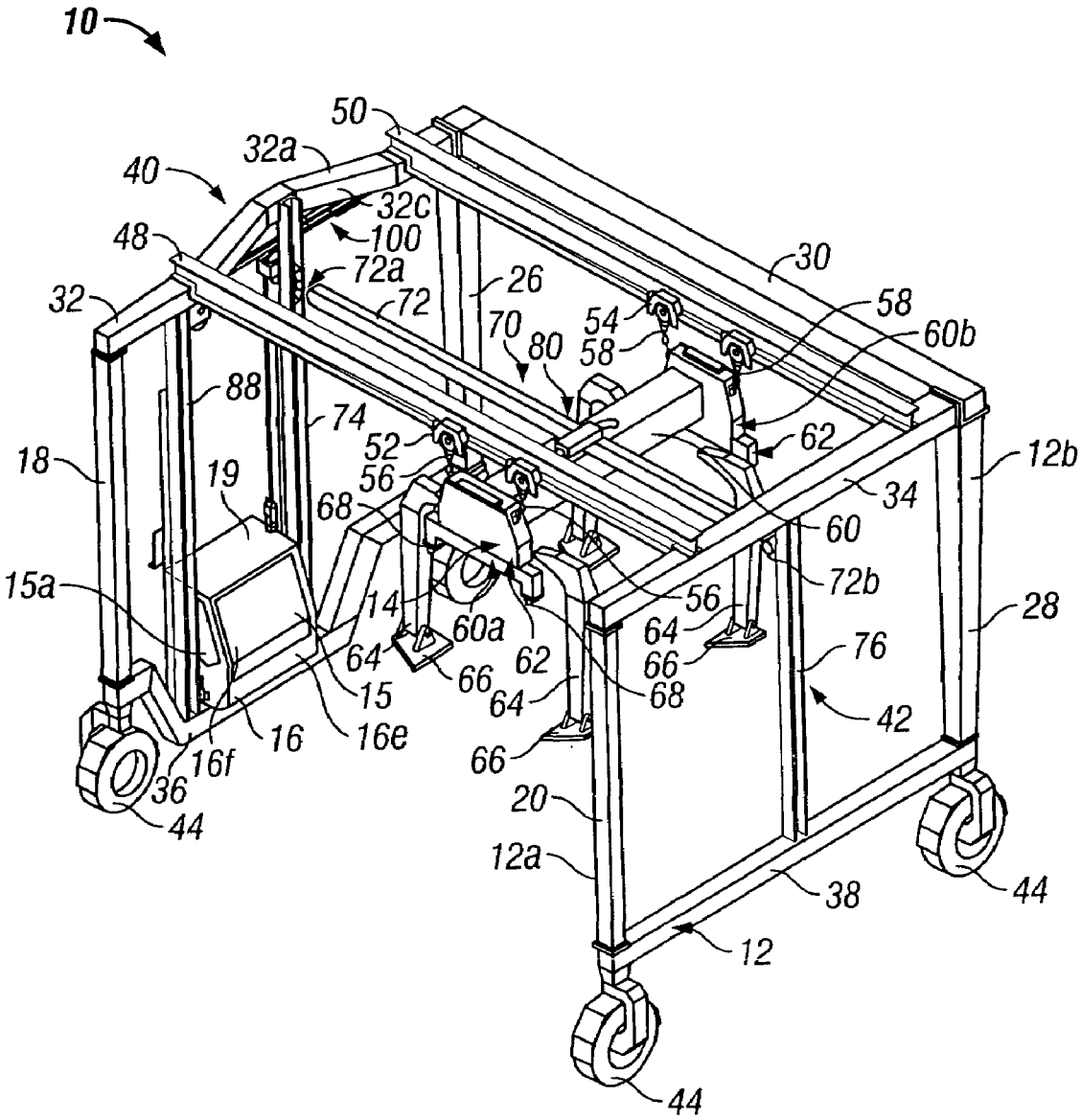
FIG. 1 is a perspective view of the gantry crane of the present invention with an operator cab on a first side support frame of the gantry crane.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

Figure 8:
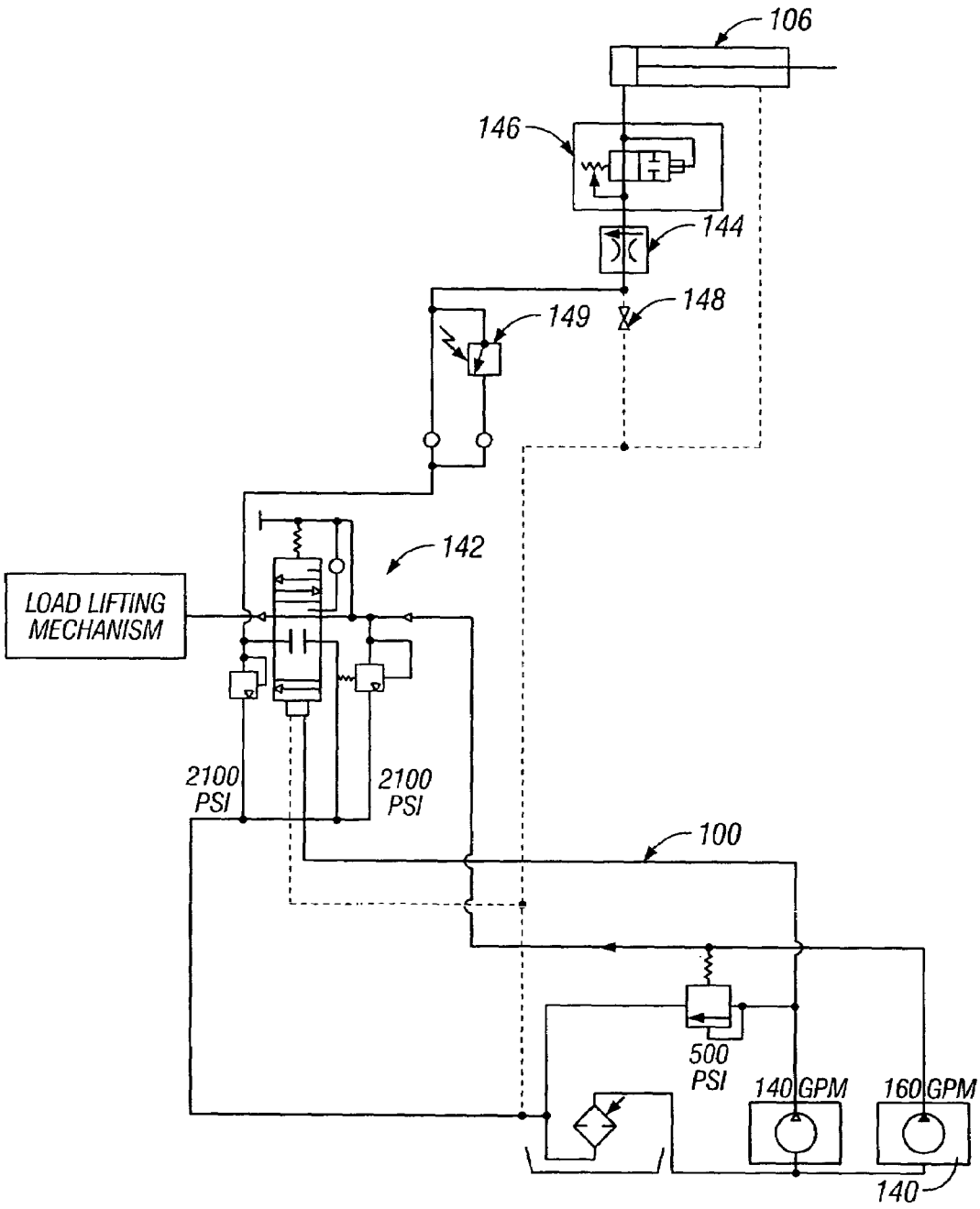
Figure 9:
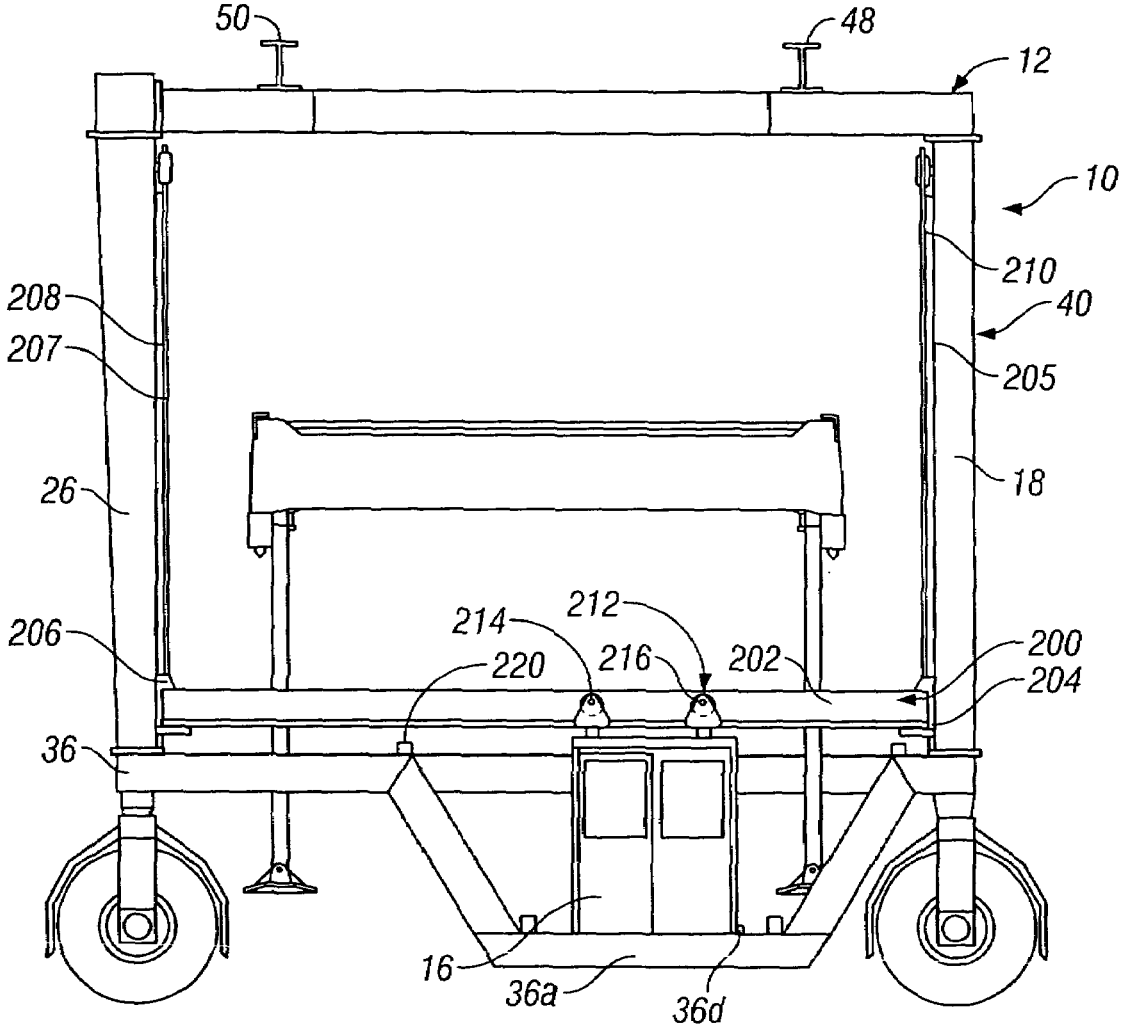
FIG. 9 is a side view of the gantry crane of FIG. 1 showing another embodiment of an elevating operator cab vertically moveable by a carriage beam; and, FIG. 10 is a side view of the gantry crane of FIG. 9 showing the operator cab in an elevated position and showing the operator cab horizontally moveable along the carriage beam.
Figure 10:
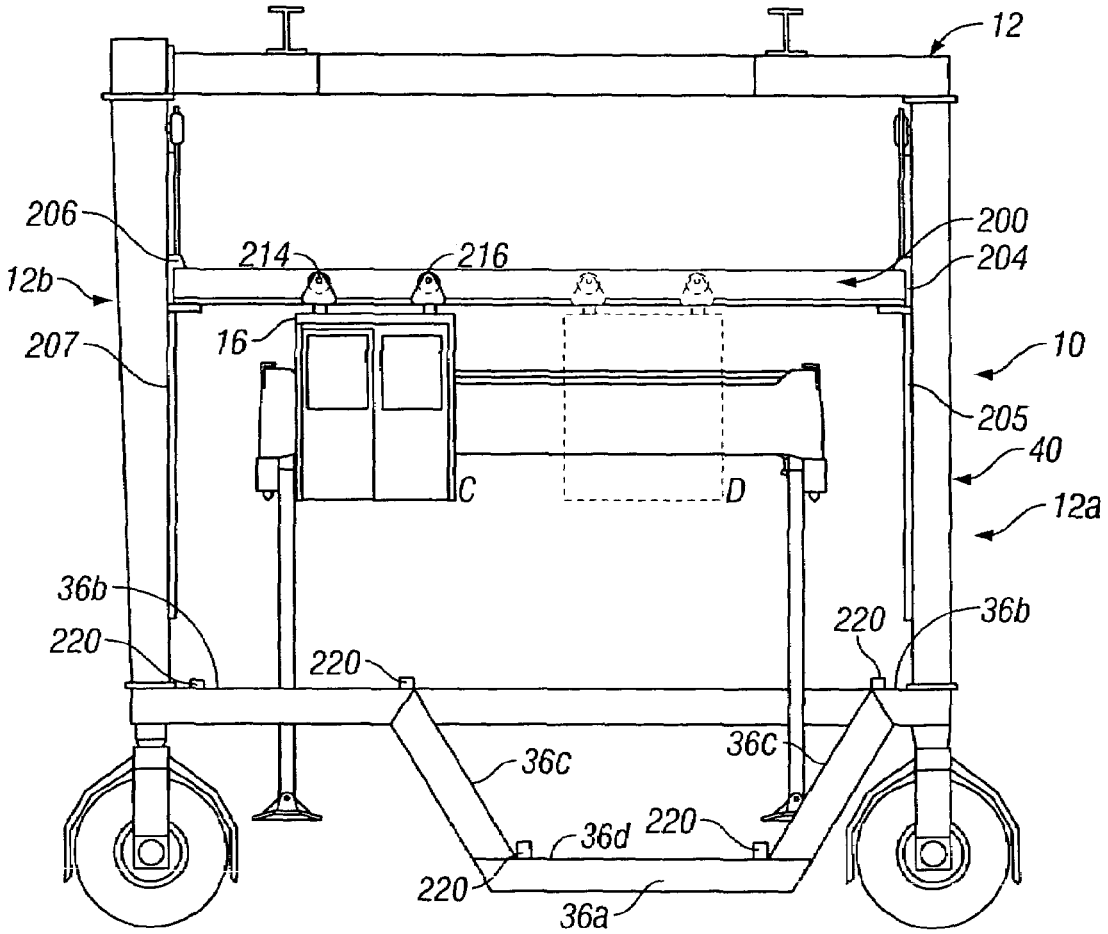

FIGS. 1–7 disclose a gantry crane 10 having a vertically moveable operator cab 16 constructed in accordance with the principles of the present invention. FIG. 8 discloses a hydraulic schematic diagram for a lifting mechanism 100 for the operator cab 16. FIGS. 9 and 10 disclose another embodiment of an elevating operator cab 16.

The structure of the gantry crane 10 and operation of the operator cab 16 will be described and then the structure and instrument and control layout of the operator cab 16 will be described in greater detail.

Gantry Crane Structure

As disclosed in FIG. 1, the gantry crane 10 generally includes a gantry structure 12, a load lifting mechanism 14 and an operator cab 16. The load lifting mechanism 14 is connected to the gantry structure and includes apparatus for lifting a load. The operator cab 16 is mounted on the gantry structure 12. As best disclosed in FIG. 2, the operator cab 16 is vertically moveable on the gantry structure 12. A lowermost position of the cab 16 is shown in solid lines at A, and an upper position of the operator cab 16 is shown in phantom lines at B.

The gantry structure 12 has four vertical legs 18, 20, 26 and 28. Legs 18 and 26 are connected near their bottom ends by a lower side beam 36 and are connected at their top ends by an upper side beam 32. Legs 20 and 28 are similarly connected near their bottoms ends by a lower side beam 38 and connected at their top ends by an upper side beam 34.

Legs 18 and 26 and the connecting upper and lower side beams 32 and 36, respectively, define a first side support frame 40. Legs 20 and 28, and the connecting upper and lower side beams 34 and 38, respectively, define a second side support frame 42. The first side support frame 40 defines an operational plane where the operator cab 16 is positioned to operate. In other words, the cab 16 intersects all possible vertical plans through legs 18 and 26 of the first side support frame 40.

The side support frames 40 and 42 are interconnected by trolley beams 48 and 50 which are spaced from each other. The trolley beams 48 and 50 are preferably I-beams and are mounted on an upper side of the top side beams 32 and 34. As further disclosed in FIG. 1, a top beam 30, spanning between the side support frames 40 and 42, is provided at a front end 12*b* of the gantry structure 12. The primary function of top beam 30 is to provide structural integrity to the gantry structure 12. It also provides a mounting bridge for routing hydraulic and electrical circuitry between the side support frames 40 and 42.

The gantry structure 12, thus formed, is an open-ended box-like structure sufficient to span over adjacent loads, such as two railcars or a railcar adjacent a truck trailer. The benefits of the present invention, however, can be realized with other gantry structures. For instance, a two-legged gantry structure utilizing only one trolley beam and trolley could also be used. Thus, each side support frame would include one leg, and the leg of each side support frame would be connected by a beam.

The gantry structure 12 is also equipped with four (4) wheels 44. One wheel 44 is located at a bottom end of each of the vertical legs 18, 20, 26 and 28. The wheels 44 are powered by hydraulic motors (not shown) to make the gantry crane 10 self-mobile. The wheels 44 could also be railroad wheels that ride on railroad tracks. The gantry structure 12 could also be equipped with link-belt type tracks as used on many boom-type cranes.

Figure 2:
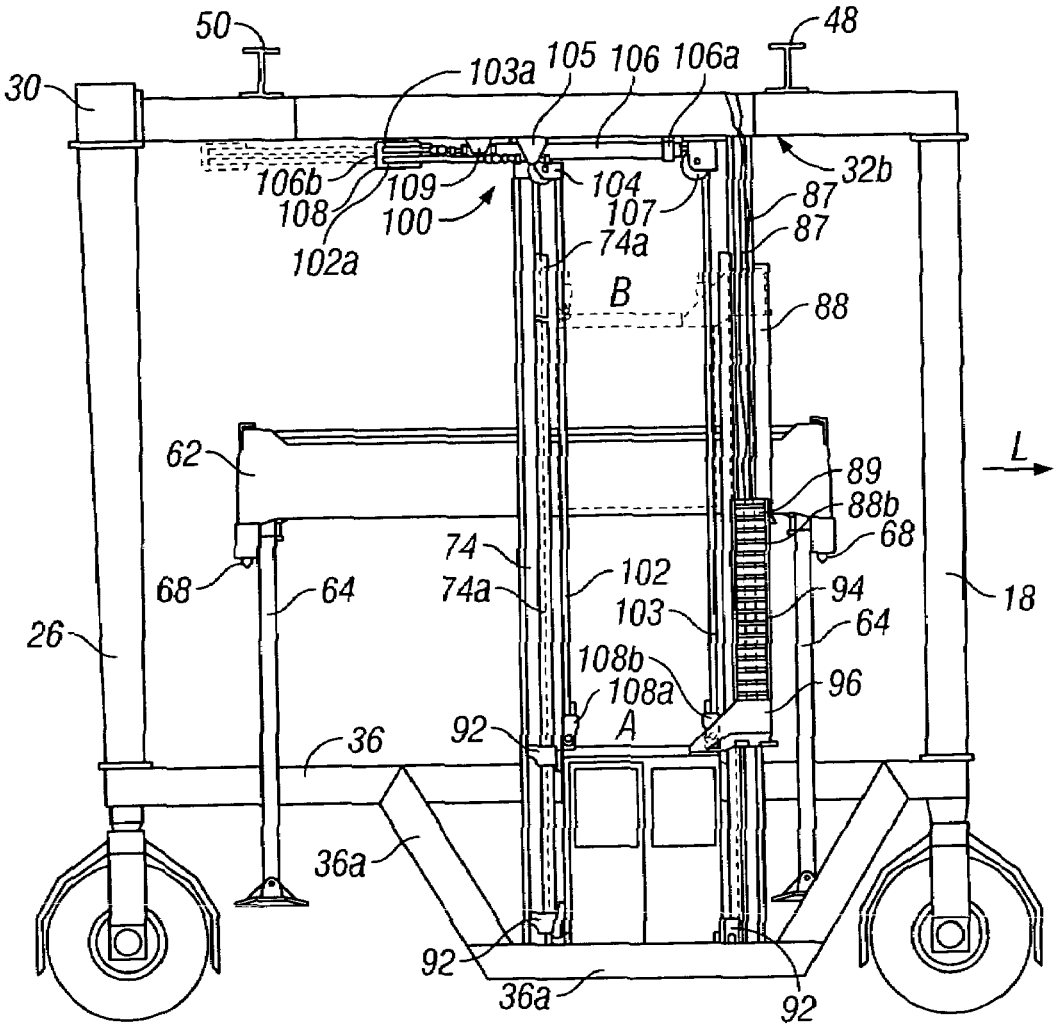
FIG. 2 is a side view of the gantry crane of FIG. 1 disclosing the operator cab accommodated by a downwardly-extending portion of a lower side beam of the first side support frame, the operator cab being at a lowermost position with an upper position shown in phantom lines.

As best disclosed in FIGS. 1 and 2, the load lifting mechanism 14 is comprised of a conventional apparatus including first and second trolleys 52, 54, first and second lift cables 56, 58 and a lift frame 60. The first trolley 52 rides on trolley beam 48 positioned towards a rear end 12*a* of the gantry structure 12. The second trolley 54 rides on trolley beam 50 positioned towards the front end 12*b* of the gantry structure 12. A rear end 60*a* of the lift frame 60 is suspended from the first trolley 52 by a first lift cable 56. A front end 60*b* of the lift frame 60 is suspended from the second trolley 54 by a second lift cable 58. The lift cables 56 and 58 extend from the trolleys to winches (not shown) that are mounted on the gantry structure 12. The winches raise and lower the lift frame 60 via the lift cables 56 and 58 toward and away from the first and second trolleys 52 and 54. As the trolleys 52 and 54 move laterally on the trolley beams 48 and 50, the lift frame 60 is moved laterally within the gantry structure 12.

As best disclosed in FIGS. 1 and 2, the lift frame 60 is equipped with a pair of spreaders 62. The spreaders 62 have arms 64 that depend from the lift frame 60. Each arm 64 has a pivot shoe 66, that can engage the bottom side of a load, such as a truck trailer. When it is desired or necessary to engage a load at its top, the arms 64 can rotate out of the way (in the direction of the arrow in FIG. 2) and the load can be engaged by specialized twist locks 68 located on the lift frame 60. The spreaders 62 on the lift frame 60 can extend longitudinally within the gantry structure 12 to adjust to various load lengths. The lift frame 14 also houses various control mechanisms for the spreaders 62, as is conventional.

The gantry crane 10 is also equipped with stabilizing apparatus 70 to prevent unwanted sway of the lift frame 60 within the gantry structure 12. The stabilizing apparatus generally includes a horizontal stabilizing beam 72 with vertical guides 74,76 to prevent longitudinal and lateral sway, i.e., pendulous motion of the lift frame 60. A reeving arrangement (not shown), attached between the trolleys 52,54 and the lift frame 60, is used to dampen rotational sway, i.e., twisting of the ends 60*a*,60*b* of the lift frame 60. As best disclosed in FIG. 1, the stabilizing beam 72 operatively connects the lift frame 60 to the gantry structure 12. The lift frame 60, is pivotally connected to the stabilizing beam by a gimbal 80. Ends 72*a*,72*b* of the stabilizing beam 72 are connected to the vertical guides 74,76 that are connected to the side support frames 40,42 respectively. In a preferred embodiment, the vertical guides 74,76 are vertical guide tracks, e.g., I-beams, that extend between the upper side beams 32,34 and lower side beams 36,38 of each side support frame 40,42. The stabilizing beam 72 is vertically moveable along the vertical guide tracks 74,76 as the lift frame 60 is raised and lowered. With the stabilizing beam 72 connected to the lift frame 60 and vertical guide tracks 74,76, longitudinal and lateral sway of the lift frame 60 is prevented.

Operator Cab On Gantry Structure

Figure 3:
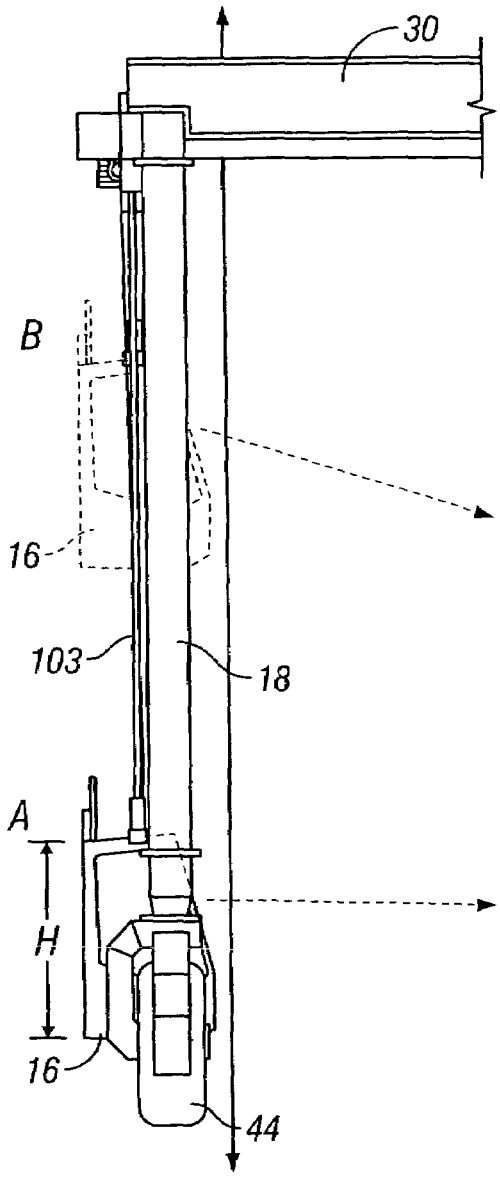
FIG. 3 is a partial rear view of the gantry crane of FIG. 1 disclosing the operator cab intersecting an operational plane defined by the first side support frame, the operator cab being in a lowermost position; an upper position is shown in phantom lines.

As best disclosed in FIGS. 2 and 3, the operator cab 16 is vertically moveable in the operational plane defined by the first side support frame 40. The operational plane extends between the vertical legs 18,26. The cab is lifted by a lifting mechanism 100 to be described below. The cab 16 can thus, traverse in a vertical path between a lowermost position, designated at A, and an uppermost position, designated at B (shown in phantom lines). The uppermost position B could vary depending on the design of the crane. The larger the gantry crane 10, the higher the operator cab 16 can move vertically. In the present invention, the uppermost position of the operator cab is approximately 21 feet. In addition, the operator cab 16 can be stopped at any position between the lowermost position A and the uppermost position B providing completely variable vertical lines of sight to the operator when operating the gantry crane 10.

A vertically moveable operator cab is especially desirable with intermodal operation where the gantry crane 10 is lifting loads using the spreader arms 64, such as truck trailers, or lifting loads using the specialized twist locks 68, such as cargo containers. For example, when lifting a truck trailer, the spreader arms 64 engage the trailer at its bottom. When an operator attempts to engage the spreader arms under a trailer, his view is best when looking directly across at the bottom the trailer and spreader arms. Thus, an optimum line of sight may be obtained by positioning the operator cab 16 near ground-level, as represented by the solid lines in FIG. 3. Conversely, when lifting a cargo container, the specialized twist locks 68 engage the container at its top. When the operator aligns the twist locks 68 with the container, his view is best when positioned at an elevated position looking over the container top. Thus, by vertically moving the operator cab 16 to a position such as B, the operator may obtain a direct view of an upper portion of the container and lift frame 60, as represented by the dotted line in FIG. 3. The vertical position of the operator cab 16 can be readily changed depending on the type and size of the load being lifted.

In order to add stability to the vertically moveable operator cab 16, the cab 16 is moveable along first and second spaced vertical guides 74,88 connected to the first side support frame 40. In its preferred form, the guides 74,88 are vertical guide tracks, or I-beams. Also, the first vertical guide track 74 functions as both the guide track for the stabilizing beam 72 and the operator cab 16. As best disclosed in FIGS. 2 and 5, an additional flange 74*a* is attached to the first vertical guide track 74 for cooperation with the operator cab 16. Likewise, a flange 88*a* is attached to the second vertical guide track 88 for cooperation with the operator cab 16. However, separate vertical guide tracks could be used for the stabilizing beam 72 and operator cab 16, if desired. Using the guide track 74 for both the stabilizing beam 72 and operator cab 16 saves material and reduces the weight of the gantry crane 10. Further, a single guide track 74 on either side of the cab 16 could be used to guide the operator cab 16. Two guide tracks are preferred, however, to add stability to the operator cab 16 when being moved vertically.

Still referring to FIG. 2, the first and second guide tracks 74,88 extend between the lower side beam 36 and upper side beam 32 and in the operational plane defined by the first side support frame 40. The operator cab 16 is positioned between the guide tracks 74,88 and has a pair of slotted brackets 92 on opposing sides of the operator cab 16. As best disclosed in FIG. 5 or 7, the slotted brackets 92 define a slot 93 which engages around the guide tracks 74,88. Specifically and as best disclosed in FIG. 7, the assemblies 92 have tab portions 92*a* that fit on either side of the flange 74*a* of the first guide track 74 and flange 88*a* of the second guide track 88. The slotted brackets 92 prevent the operator cab from swaying out of the operational plane during vertical movement. Shims 92*b* can be added to the slotted brackets 92 for a close-fit with the guide tracks 74,88, and are preferably made of resilient low-friction materials, such as polypropylene plastic.

The side support frame 40 has a number of features to enhance the lines of sight obtainable to an operator in the operator cab 16 and the operator's ability to operate the gantry crane more efficiently. As best disclosed in FIGS. 1 and 2, the lower side beam 36 of the first side support frame 40 has a downwardly-extending portion 36*a* that accommodates the operator cab in its lowermost position. The first and second vertical guide tracks 74,88 are connected to the first side support frame 40 within the confines of downwardly-extending portion 36*a*. With conventional designs, the lower side beam 36 extends directly horizontally from the front leg 26 straight across to the rear leg 18 several feet from the ground. The lowermost position of the operator cab 16 would be defined by the straight lower side beam causing the operator cab 16 to rest too far above ground-level. Such a design makes it impossible for the operator to have a line of sight directly across at a bottom of a truck trailer a few feet from ground-level. The downwardly-extending portion 36*a* of the first side support frame 40 accommodates the operator cab 16 at a position which allows the vertically-moveable operator cab 16 to be positioned close to ground-level. This improves an operator's view when engaging a load at its bottom.

Figure 4:
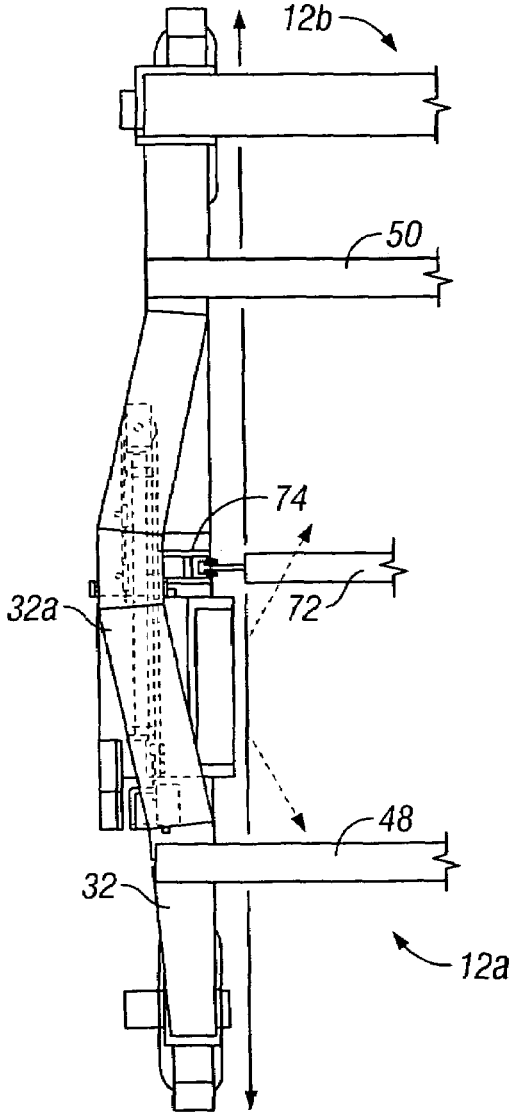
FIG. 4 is a partial plan view of the crane of FIG. 1 disclosing an upper side beam of the first side support frame having an outwardly extending portion.

Another feature that improves the operator's vision is best disclosed in FIGS. 1 and 4. The upper side beam 32 of the first side support frame 40 has an outwardly extending portion 32*a*, i.e., the side beam extends outwardly from the gantry structure 12. This feature allows the vertical guide tracks 74,88 to be recessed with respect to the operator cab 16 while maintaining the operator cab 16 in the operational plane defined by the first side support frame 40. With this configuration and as best shown in FIG. 4, the tracks 74,88 are not in the operator's line of vision looking towards the rear end 12*a* and front end 12*b* of the gantry structure 12.

As previously noted, the first and second guide tracks 74,88 extend between the lower side beam 36 and upper side beam 32 of the first side support frame 40. The second vertical guide track 88 is connected at a bottom side 32*b* of the upper side beam 32. The first guide track 74, however, must extend beyond the upper side beam 32 to accommodate the stabilizing beam 72 when the lift frame 60 is at its highest position. Therefore, the first guide track 74 must be mounted on an inner side 32*c* of the upper side beam 32 as disclosed in FIG. 1. However, the operator cab 16 also is guided by the first guide track 74. If this connection was to an inner side of a straight upper side beam having no outwardly extending portion, the resulting position of the first guide track 74 would be towards the front of the operator cab 16. The first guide track 74 would then obstruct the operator's view towards the front end 12*b* of the gantry structure 12. Alternatively, such a position of the first guide track 74 would also cause the operator cab 16 to extend further within the gantry structure 12 and beyond the operational plane defined by the first side support frame 12. The operator cab would extend inwardly across an inner clearance line of the gantry structure, the inner clearance line being shown in FIGS. 3 and 4. This is undesirable because it is important to maximize the space within the gantry structure 12 to provide enough clearance between the load and side support frames.

With the present design, the first guide track 74 is accommodated on the inner side 32*c* of the upper side beam 32, while the outwardly-extending portion 32*a* of the upper side beam 32 allows the first guide track 74 to be set back with respect to the operator cab 16. Thus, the operator cab 16 is within the operational plane defined by the first side support frame 40 and the first guide track 74 does not obstruct the operator's view towards the front end 12*b* of the gantry structure 12, as shown by the dotted line in FIG. 4, because the guide track is recessed.

The operator can control all of the movements of the gantry crane from the operator cab 16. The cab 16 is provided with controls for a hydraulic steering system that controls the wheels 44, the load lifting mechanism 14 and the lifting mechanism 100 for the operator cab 16 and the operation of the cab 16 itself. Accordingly, control lines 87 extend from different sections of the crane 10 to the operator cab 16. As best disclosed in FIGS. 1 and 2, these lines come together proximate the upper side beam 32 of the first side support frame 40. The lines then advance downwardly along the second vertical track 88 and enter a junction cluster 89 at an intermediate location 88*b* on the second guide track 88. The lines then extend back upwardly from junction cluster 89 to a flexible link conduit 94. The flexible link conduit 94 forms an upwardly extending loop from the intermediate location 88*b* and the operator cab 16. The flexible link conduit 94 is sectioned to separate the control lines 87 side-by-side. The link conduit 94 is anchored to a conduit bracket 96, which is affixed to the top of cab 16. The control lines 87 extend from the end of the link conduit 94 to points on the cab 16 sidewall. The control cables then are ported through the sidewall and are connected to the various controls and gauges inside the operator dab. As the operator cab is elevated, the link conduit 94 carries the lines 87 upwardly as the curled loop portion of the link track moves vertically along the second guide track. The link track thus keeps the lines from getting tangled and possibly getting caught in the slotted brackets 92 of the operator cab 16.

As previously noted, the operator cab 16 is vertically moveable by the lifting mechanism 100 in the operational plane defined by the first side support frame 40. As best disclosed in FIG. 2, the operator cab 16 is lifted by a pair of lift cables 102 and 103. Each lift cable 102,103 has a length and has a first end fixed to the operator cab 16. The lift cable 102 has a second end fixed to the first side support frame 40 at bracket 105. The lift cable 103 has a second end fixed to the first side support frame 40 at bracket 109. A hydraulic cylinder 106 is provided to urge the lift cable 102 between its fixed first and second ends in a direction transverse to a portion of its length.

A first pulley 104 is mounted on the upper side beam 32 of the first side support frame 40 proximate the first guide track 74. A second pulley 107 is mounted on the upper side beam 32 of the first side support frame 40 proximate the second guide track 88.

The hydraulic cylinder 106 has one end 106*a* mounted on a bottom side 32*b* of the upper side beam 32 of the first side support frame 40. The hydraulic cylinder 106 has an opposed end 106*b* adapted to contact the cab lift cables 102,103. It will be appreciated that the cylinder 106 could also be fixed to the upper side beam at additional locations for added stability. The cylinder 106 has an extension path which is transverse to a portion 102*a*,103*a* of the length of lift cables 102,103. In its preferred embodiment, the opposed end has a double-sheeve pulley 108 mounted thereon. Transverse direction means any direction or angle other than along the length of the portion of the cable, in other words, any direction tending to move the cable out of its path.

The cab lift cables 102, 103 follow similar paths. Lift cable 102 has one end fixed to a first bracket 108*a* on the operator cab 16. The lift cable 102 extends upwardly and around the pulley 104. The cable 102 proceeds around the double-sheeve pulley 108 and is fixed to the upper side beam 32 at bracket 105. The lift cable 103 has one end fixed to second bracket 108*b* on the operator cab 16. The lift cable 103 extends upwardly and around the pulley 107. The cable 103 advances around the double-sheeve pulley 108 and is fixed to the upper side beam 32 at bracket 109.

The extension path of the cylinder 106 is such that the opposed end 106*b* of the cylinder 106 urges the cables 102,103 in a portion 102*a* and 103*a* of its length lying between the pulleys 104,107 and the second ends fixed at the brackets 105,109. Thus, as the cables 102,103 are urged in a direction transverse to their lengths by the cylinder 106 (shown in phantom lines in FIG. 2), the operator cab 16 is vertically moved from the lowermost position A to an upper position B. The hydraulic cylinder 106 can be controlled to position the operator cab 16 anywhere along the guide tracks 74,88 between its lowermost and uppermost positions. As best disclosed in FIG. 8, the hydraulic cylinder 106 has fluid connections at both ends of the cylinder 106 to better control the extension of the cylinder and vertical movement of the operator cab 16. Thus, the vertically moveable operator cab allows the operator to vary his lines of sight (dotted lines in FIG. 3) to improve his vision from the operator cab 16.

There are also other means contemplated for vertically moving the operator cab 16. For example, a single lift cable attached nearer the center of cab 16 could be used. Also, a winch could be mounted on the gantry structure with a cable having opposing ends fixed to the winch and gantry structure. The winch, with appropriate cable guides and pulleys, could be positioned in any of a number of locations on the gantry structure as well. The cable is accumulated by the winch, thus, vertically moving the operator cab 16.

A driven gear mechanism cooperatively engaging the operator cab and guide tracks 74,88 could also be used. For example, drive gears could be mounted on the operator cab to mesh with a toothed-guide track. Similarly, a chain and sprocket arrangement could also be utilized. A hydraulic lift cylinder could be mounted to either a bottom of the operator cab 16 or to the top of the cab 16 to vertically move the cab by extension of the cylinder. Also, a counterweight system could be used.

Figure 5:
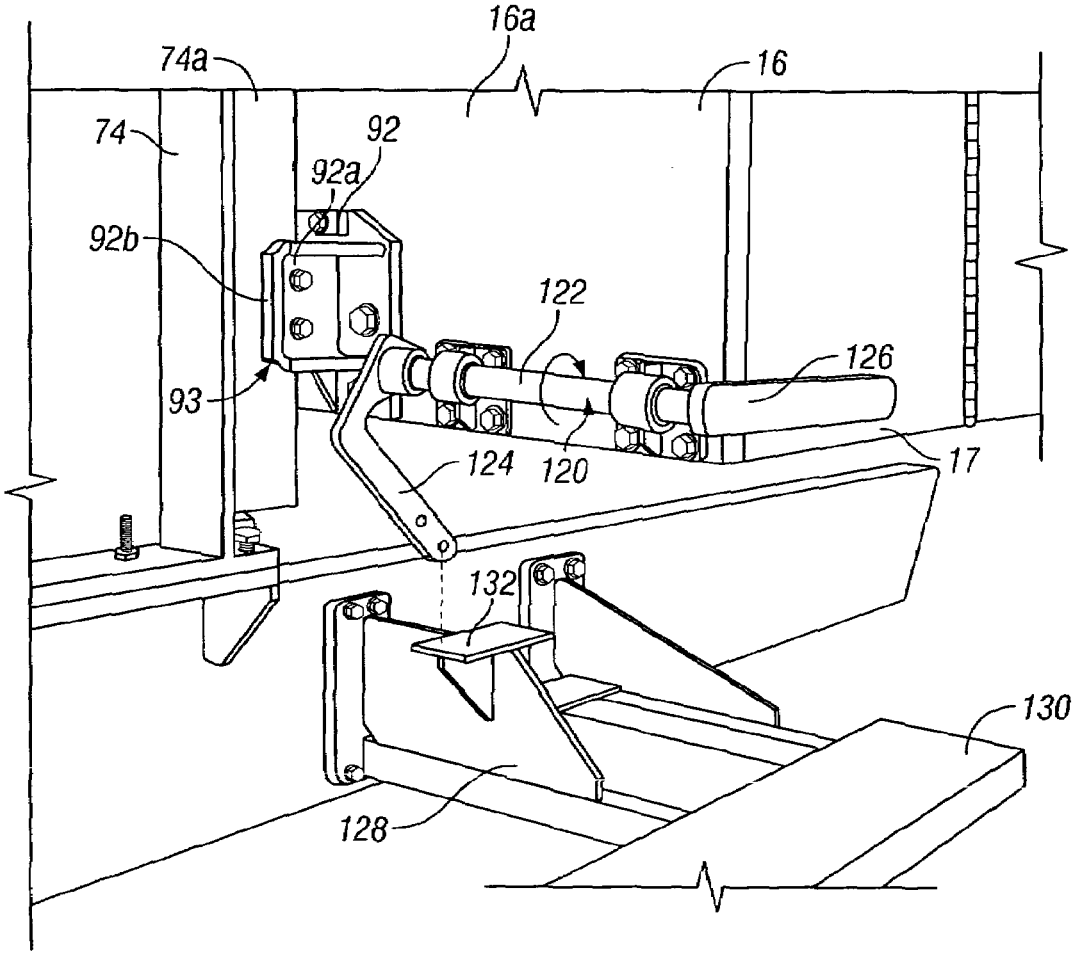
FIG. 5 discloses an enlarged perspective view of the crane of FIG. 1 disclosing a mechanical safety device in a closed position.
Figure 6:
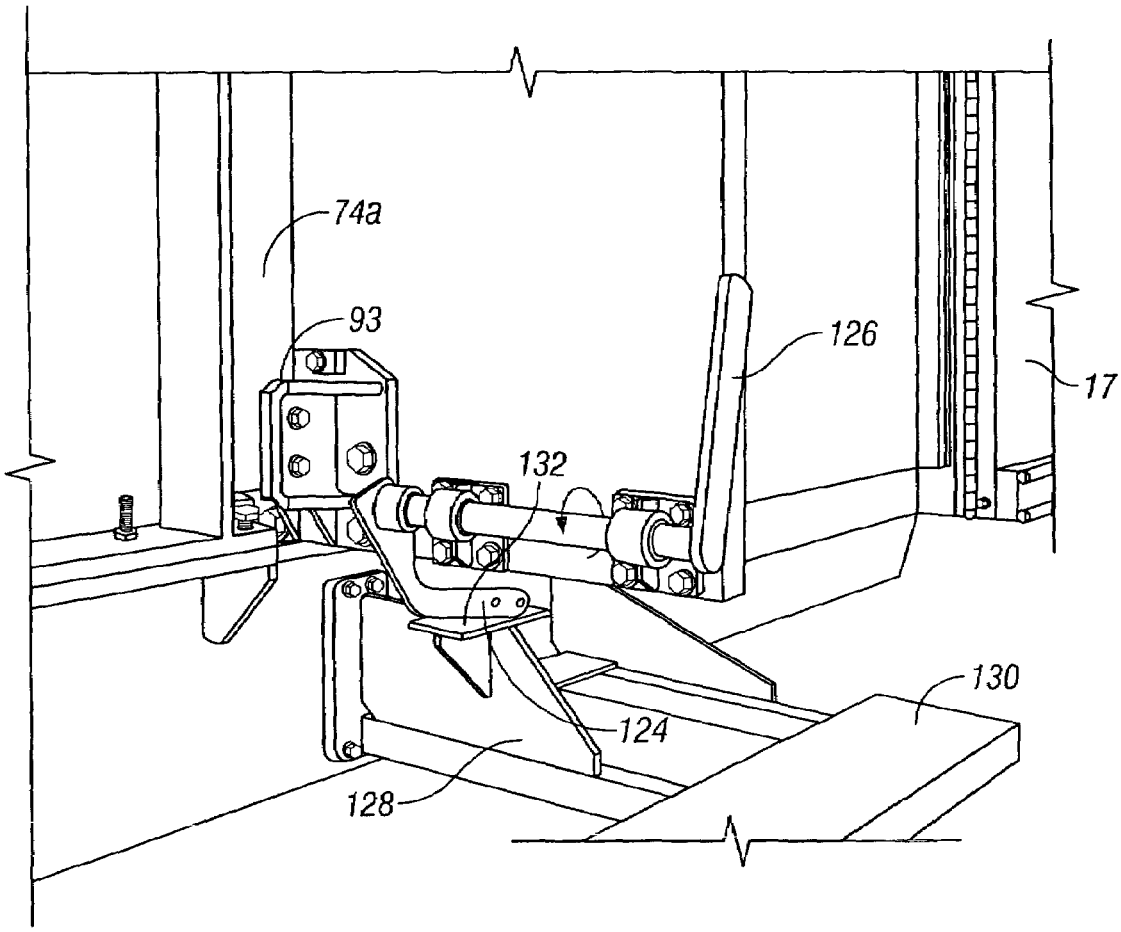
FIG. 6 discloses an enlarged perspective view of the mechanical safety device of FIG. 5 disclosing an open position.

It is important to provide safety measures to prevent an operator from accidentally falling out of the operator cab 16 when vertically moved to an elevated position. As best disclosed in FIGS. 5 and 6, a mechanical safety device 120 is provided to prevent an access door 17 of the operator cab 16 from fully opening when the operator cab 16 is raised from its lower-most position. The device 120 generally includes a shaft 122 having a first arm 124 and a second arm 126 mounted thereon. The shaft 122 is rotatably mounted to an outside portion of the operator cab 16, for example, to a side wall 16*a* adjacent the access door 17. A step bracket 128 is mounted to the lower side beam and has a step 130 connected thereon to assist an operator getting into the cab 16. A platform 132 is mounted on the step bracket underneath the operator cab 16. When the operator cab 16 is in its lower-most position as shown in FIG. 6, the first arm 124 contacts the platform 132, maintaining the position of the shaft 120. In this position, the second arm 126 is positioned vertically beside the operator cab 16. As the operator cab is vertically moved from its lower-most position as shown in FIG. 5, the first arm 124 loses contact with the platform 132. The first arm 124 acts as a counterweight rotating the shaft 120 in the direction of the arrow in FIG. 5. As the shaft 120 rotates, the second arm 126 moves across a portion of the access door 17. A stop (not shown) is provided on the shaft 120 to maintain the second arm 126 horizontally across the access door 17. Thus, when the operator cab 16 is elevated as in FIG. 5, the second arm 126 prevents the access door 17 from fully opening.

FIG. 8 discloses schematically the hydraulic circuit for controlling the cylinder 106 of lifting mechanism 100. Generally, hydraulic fluid is supplied from a 16 gallon per minute pump 140 through associated valving to the hydraulic cylinder. Fluid return lines are also provided. The circuit has certain safety features that protect the operator and the gantry crane 10. For instance, the cylinder 106 cannot elevate the operator cab 16 at the same time as operating the spreader 62 functions of the load lifting mechanism 14, such as the moving of the spreader 62 arms and vice versa. The functions of spreader 62, however, can be operated when the cab is being lowered. The operator can advance the vertical position of the operator cab 16 and then operate the spreader 62. If desired, in alternate embodiments, the entire operation of the lifting mechanism 100 could be prevented when operating the load lifting mechanism 14. A control/switching valve 142 is provided that directs hydraulic fluid to either the spreader 62 or the cylinder 106 mechanism. Thus, when raising the cab 16, hydraulic fluid cannot reach the load lifting mechanism 14 to operate the spreaders 62. Hydraulic fluid cannot reach both mechanisms at the same time to operate them simultaneously. Also a flow control valve 144 and velocity fuse valve 146 are provided in series between the control/switching valve 142 and the hydraulic cylinder 106. When the operator wishes to lower the operator cab 16 from an elevated position, the hydraulic fluid must be relieved from the cylinder 106. The flow control valve 144 is manually set to control the rate of fluid being relieved from the cylinder. Preferably, the valve 144 regulates flow at 16 GPM to correspond to the pump capacity. This assures the operator cab is lowered smoothly and at a controlled rate identical to the rate at which the cab 16 is raised.

If the flow control valve 144 malfunctioned, hydraulic fluid could be relieved at a rate much greater than 16 GPM. This could possibly allow the operator cab to free-fall less any friction between the operator cab guide brackets 92 and the guide tracks 74,88. The velocity fuse valve 146 is provided to prevent such a scenario. The velocity fuse valve 146 senses the rate at which fluid is relieved from the cylinder. The valve 146 is set to close once the rate exceeds a nominal closing flow. For cab 16, the set point is 25 GPM. If the velocity fuse valve 146 senses more than 25 GPM, it will close. The remaining hydraulic fluid is then trapped in the cylinder. Consequently, the operator cab is stopped. Preferably, the velocity fuse valve 146 is positioned in closed proximity to the hydraulic cylinder to minimize response time. Both the flow control valve 144 and velocity fuse valve 146 are available from Vonberg Valve, Inc.

Also, it is possible though unlikely, for a system malfunction to maintain the operator cab 16 at an elevated position. Without hydraulic control, the operator cab 16 would be stranded at the elevated position. Therefore, the hydraulic circuit is provided with a manual flow control valve 148 as shown in FIG. 8. This valve is located inside the operator cab 16 (not shown) so that an operator could manually relieve the hydraulic pressure in the cylinder 106 and lower the operator cab 16. Thus, if a control malfunction stranded the operator cab at an elevated position, the operator can still lower the cab to its lowermost position. Also, a flow switch 149 is provided in the hydraulic circuit. As hydraulic fluid is relieved from the cylinder 106, the flow switch 149 activates an alarm (not shown) to alert bystanders that the cab 16 is being lowered.

Finally, there is provided another safety feature that prevents the operator cab 16 from being vertically moved when the access door 17 on the cab 16 is not closed. As best disclosed in FIG. 7, a closed door limit switch 152 is provided on the access door operator cab 16 at the access door 17. The closed door limit switch must be made up, i.e., the access door 17 of the operator cab 17 must be closed before the cab 16 can be vertically moved.

Another feature is use of the Digitrac valves for enhancing the control of vertical movement of the operator cab 16. These valves are spooled by servo-motors. The vertical movement of the cab 16 is controlled through software, in digital steps. The Digitrac valves dampen the response of the hydraulic system so that the operator cab 16 starts and stops smoothly.

FIGS. 9 and 10 disclose another embodiment of an elevating operator cab 16. The gantry crane shown in FIGS. 9 and 10 is similar to the gantry crane 10 in FIGS. 1–8 and, therefore, like structures will be referred to with identical reference numerals. This embodiment generally includes the operator cab 16 and a lifting mechanism 200. The operator cab 16 could also be replaced by any number of different operator cab styles or designs adapted to house controls for operation of the gantry crane 10. The lifting mechanism 200 includes a horizontally extending carriage beam 202. The carriage beam 202 is connected to the operator cab 16 and is used to hoist and, thus, vertically move the operator cab 16. The carriage beam 202 extends between the front leg 18, or column 18, and the rear vertical leg 26, or column 26, of the first side support frame 40. The carriage beam 202 is preferably horizontal although the beam 202 could be configured to slope slightly. The carriage beam 202 lies within the operational plane defined by the first side support frame 40. The carriage beam 202 has a pair of guides 204,206 that ride along guide rails 205,207 to vertically guide the carriage beam 202. The guides 204,206 are shown moving along the guide rails 205,207 at a face of the vertical legs 18,26 although the guides 204,206 could be configured to circumferentially engage the legs 18,26. In addition, the legs 18,26 could include a channel to accommodate the guides 204,206 for guided movement of the carriage beam 202. Furthermore, the guide rails 205,207 could be mounted inwardly, in spaced relation from the vertical legs 18,26 if desired. In a preferred embodiment, however, the guide rails 205,207 are connected to the vertical legs 18,26 to vertically guide the carriage beam 202 along the legs 18,26.

The lifting mechanism 200 also includes structure to hoist the carriage beam 202 to vertically move the operator cab 16. This structure can include a pair of lift cables such as cables 208,210 connected to the carriage beam 202. The lift cables 208,210 can be utilized in a hydraulic cylinder/pulley arrangement as disclosed in FIGS. 1–4. The lift cables 208,210 can also be used in a lifting mechanism such as the hoisting means disclosed in U.S. Pat. No. 5,529,452. This type of lifting mechanism could include carriage means fixed on opposite ends of the carriage beam 202 that cooperate with guides mounted to the vertical legs 18,26. This mechanism could include a bell crank/pawl arrangement to lock the carriage beam 202 against downward movement in the event one of the cables 208,210 becomes slack as, for example, when a cable or cables accidentally break, as disclosed in U.S. Pat. No. 5,529,452. The lifting mechanism 200 could also utilize conventional winches mounted on the gantry structure to accumulate the lift cables 206,208 and, therefore, lift the carriage beam 202 and operator cab 16. Hydraulic cylinders connected directly between the gantry structure 12 and the carriage beam 202 could also be used.

As shown in FIG. 10, the operator cab 16 moves vertically with the carriage beam 202. In the present invention, means are provided to move the operator cab 16 horizontally along the carriage beam 202. In a preferred embodiment, the operator cab 16 is connected to the carriage beam 202 by a trolley 212. The trolley 212 has a pair of trolley wheels 214,216. It is appreciated that the trolley wheels include wheels mounted on a rear side of the carriage beam 202. The trolley wheels 214,216 are supported on the carriage beam 202 and roll along the beam 202. As shown in FIG. 10, the trolley wheels 214,216 allow the operator cab 16 to move horizontally along the carriage beam 202 to a point proximate the front end 12*b* of the gantry structure 12 to a point proximate the rear end 12*a* of the gantry structure 12. Position C shows the operator cab 16 towards the front end 12*b* and Position D (phantom lines) shows the operator cab 16 towards the rear end 12*a*. The operator cab 16 is moveable along the entire length of the carriage beam 202.

The trolley 212 used to horizontally move the operator cab 16 along the carriage beam 202 can be similar to the conventional trolleys 52,54 used to move the lift frame 60 along the trolley beams 48,50. The trolley 212 can be moved along the beam 202 using conventional cables, pulleys and winches mounted on the gantry structure (not shown). Independently powered trolleys could also be used.

A number of other different structures can be used to horizontally move the operator cab 16. For instance, a taut cable could span between the legs 18,26 and the cab 16 could be adapted to move along the cable. The operator cab could also be equipped with a sleeve that circumferentially engages a beam spanning between the guide rails. The operator cab 16 could be connected to a horizontally disposed cylinder that extends and retracts to horizontally move the cab 16. In addition, a double-ended hydraulic cylinder could be mounted on the vertical legs 18,26 wherein the cab 16 is mounted to the cylinder. The double-ended cylinder typically has two ends that would span between the vertical legs 18,26. If a two-legged gantry crane is utilized, a carriage beam 202 could be attached to the vertical leg proximate a center of the carriage beam 202. The carriage beam 202 would then be cantilevered at each of its ends. Cables could be used to add stability to the cantilevered portions of the beam 202. An accordion-type structure could also be connected between the gantry structure 12 and operator cab 16 to horizontally move the cab 16. An articulated arm could also be used.

As with the previous embodiment, the operator cab 16 is moveable within the operational plane defined by the first side support frame 40. The carriage beam 202 is mounted for vertical movement along the legs 18,26, and the operator cab 16 is mounted for horizontal movement along the carriage beam 202. Accordingly, whether the operator cab 16 moves vertically or horizontally, the operator cab 16 remains within the operational plane defined by the first side support frame 40. The movement of the operator cab 16 along the carriage beam 202 further improves the operator's scope of vision. With this added movement, an operator seated in the cab 16 improves his lines of vision at the front end 12*b* of the gantry structure 12 and the rear end 12*a* of the gantry structure 12 and points therebetween. This is especially important with gantry cranes having long spans between the vertical legs 18,26. Because the operator cab 16 can move both vertically and horizontally, an almost infinite number of positions are available for the operator cab 16 to increase the operator's line of sight and improve operation of the gantry crane 10. It is contemplated that vertical movement of the carriage beam 202 can occur simultaneously with horizontal movement of the operator cab 16 along the beam 202 resulting in diagonal movement of the operator cab 16. In addition, the carriage beam 202 is mounted to a top of the operator cab 16, i.e. at a bottom of the carriage beam 202. This improves the vision of the operator seated in the operator cab 16 as it provides a substantially 360° unobstructed view out of the operator cab 16. The operator cab 16 could be mounted to a top of the carriage beam 202 as well.

It should be appreciated that the operator cab 16 could be equipped with the trolley 212 that moves along a straight side beam of a side support frame. Thus, an operator could improve his lines of vision at front and rear ends of a gantry crane regardless of whether the operator cab 16 is an elevating operator cab.

As shown in FIG. 9, the operator cab 16 rests within the downwardly extending portion 36*a* of the first side support frame 40 when in its lowermost position. In previous designs, the operator cab 16 remained vertically aligned with the downwardly extending portion 36*a*. As shown in FIG. 10, with the trolley 212 of the present invention, the operator cab 16 is moveable along the beam 202. Accordingly, the operator cab 16 can be positioned offset from the downwardly extending portion 36*a*. Consequently, means are provided for overriding operator control of the operator cab 16 and limiting movement of the cab so as to account for alignment of the cab 16 with a horizontal section 36*d* of the downwardly extending portion 36*a* of the lower side beam 36. The means could include limit switches or photocells and appropriate circuitry 220 that must be utilized to prevent the lowering of the operator cab 16 onto horizontal portions 36*b* of the lower side beam 36 and inclined portions 36*c* of the downwardly extending portion 36*a* which could damage the cab 16 or the lower side beam 36. Such means only allows the operator cab 16 to be lowered past the lower side beam 36 if the operator cab 16 is properly aligned with a horizontal section 36*d* of the downwardly extending portion 36*a* as shown in FIG. 9. The means also does not allow horizontal movement of the cab 16 when in the downwardly extending portion 36*a* (FIG. 9) to prevent collision with the inclined portions 36*c*. Finally, the means also prevents the cab 16 from colliding with the vertical legs 18,26 when in an elevated position.

It is also contemplated that the lifting mechanism 200 of this embodiment includes the necessary features to prevent free-fall of the carriage beam 202, and, thus, the operator cab 16, in the event of a lifting mechanism 200 failure. Appropriate structure can also be provided to prevent uneven lifting of the carriage beam 202.

Operator Cab Structure

Figure 7:
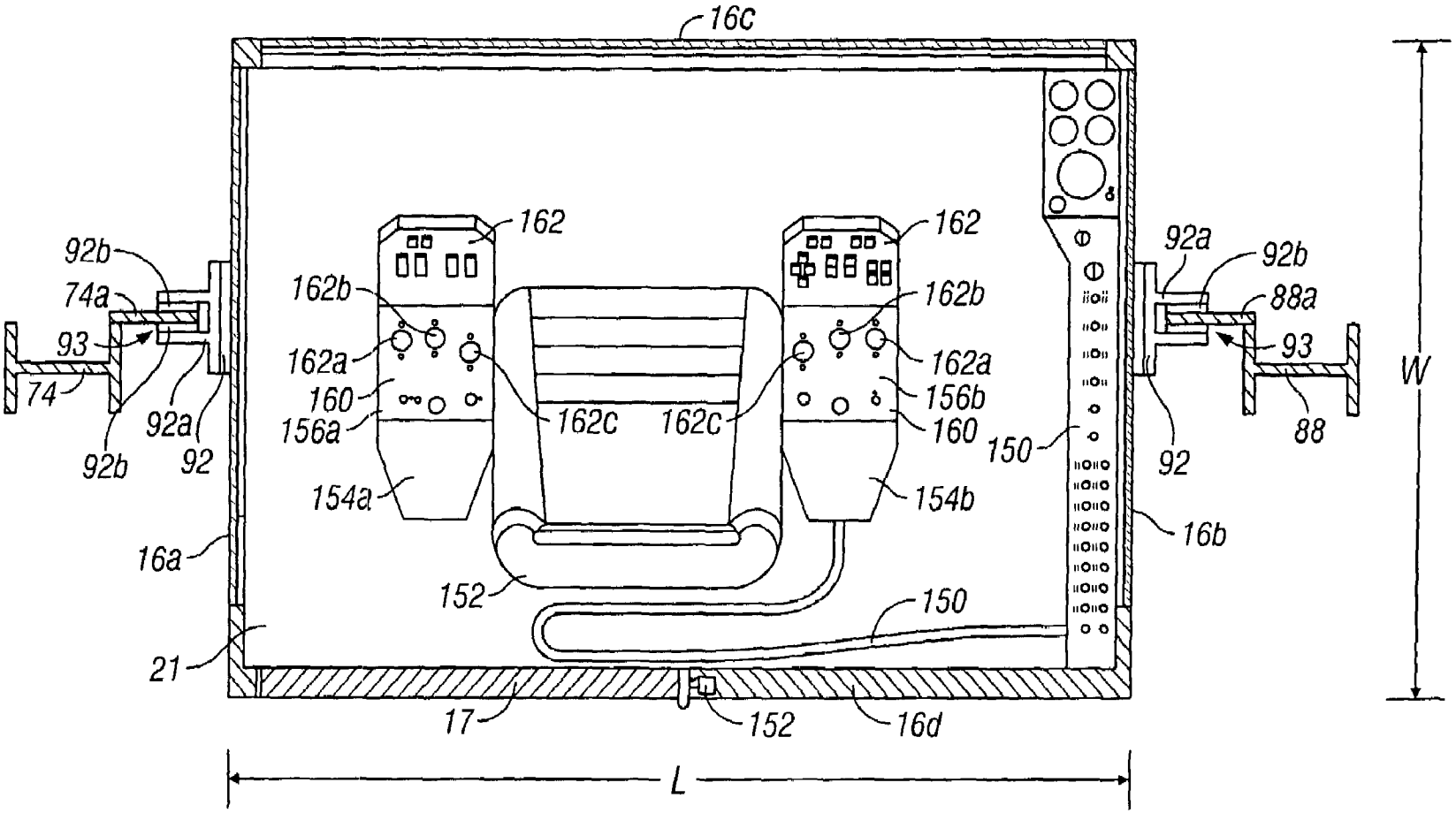
FIG. 7 is a cross-sectional plan view of the interior of the operator cab; and, FIG. 8 is a hydraulic circuit schematic for a lifting mechanism of the operator cab of the crane of FIG. 1.

FIGS. 1, 2 and 7 best disclose the exterior and interior structure of the operator cab 16. The operator cab 16 has a pair of side walls 16*a*,16*b* connected by a front wall 16*c* and rear wall 16*d*. The walls are enclosed by a top 19 and a bottom 21, thus forming a box-like structure defining a height H, a length L and a width W of the cab 16. The access door 17 of the cab is provided on the rear wall 16*d*. The door 17 opens outwardly from the gantry structure 12. The front wall 16*c* has a lower upright portion 16*e*, and an upper inclined portion 16*f*.

Each wall 16*a*–*d* has a window across substantially the entire wall. This maximizes the operator's view in all directions. In addition, the window 15 on the front wall 16*c* extends from the upper inclined portion 16*f* down into the lower upright portion 16*e*. When the operator is seated inside the operator cab 16 at an elevated position, the operator can see downwardly because the window extends into the lower upright portion 16*e*.

FIG. 7 discloses a plan view of the interior layout of the operator cab 16. Located against the side wall 16*b* is an instrument panel 150 for displaying control pressures and housing ignition switches and the like. The instrument panel 150 is contoured to follow a side window 15*a* lower edge.

An operator seat 152 is centrally mounted to the bottom 21 of the operator cab 16 and faces the front wall 16*c*. The seat 152 is equipped with arm rests 154*a*,154*b* on each side of the seat 152. Positioned slightly below and confronting each arm rest is a control pod 156*a*,156*b*. The control pods 156*a*,156*b* are manipulated by the operator to control the movements of the crane such as movement of the trolleys 52,54, lift cables 56,58, spreader arms 64, operator cab 16, or mobility of the gantry crane 10 itself. The control pods 156*a*,156*b* are adjustable on the seat to different heights from the bottom 21 of the operator cab 16.

Also, the seat is rotatable at least 45 degrees towards the instrument panel 150 and at least 90 degrees towards the opposite side wall 16*a*. The control lines 158 that feed into the operator cab 16 and control pods 156*a*,156*b* from the different locations on the gantry crane 10 rotate with the seat.

The control pod 156*a*,156*b* has a planar section 160 adjacent an inclined section 162. The planar section 160 contains three joysticks 162*a*–*c* that control various movements of the crane. The inclined section 162 houses various indicating lights and other control switches. The planar section 160 of the control pod 156*a*,156*b* confronts the arm rests 154*a*,154*b* on the operator seat 152 and is slightly lower than the arm rests 154*a*,154*b*. In such a configuration where the operator's arms are resting on the arm rests 154*a*,154*b*, the operator's hands extend easily to the control pods 156*a*,156*b*.

While the specific embodiments have been illustrated and described, numerous modifications come to mind without significantly departing from the spirit of the invention and the scope of protection is only limited by the scope of the accompanying claims.

We claim:

1. A gantry crane comprising:

first and second side support frames spaced by at least one beam;

a load lifting mechanism operable to support a load between said first and second side support frames, the load lifting mechanism and the first and second side support frames defining an operating area there between; and an operator cab including controls for moving the load lifting mechanism, wherein the operator cab is selectively moveable either horizontally or vertically in an operational plane defined by the first side support frame tangent to the operating area.

2. The gantry crane of claim 1, wherein the first side support frame includes at least two vertical legs, an upper side beam and a lower side beam, wherein the upper and lower side beams extend between the vertical legs.

3. The gantry crane of claim 2, wherein the operational plane is defined by the vertical legs, upper side beam and the lower side beam.

4. The gantry crane of claim 1, further comprising a generally horizontal carriage beam disposed within the operational plane and vertically movable, and wherein the operator cab is movably connected to the carriage beam.

5. The gantry crane of claim 4, wherein the first side support frame includes at least two vertical support rails, and wherein the carriage beam is guided vertically along the rails.

6. The gantry crane of claim 4, further comprising a trolley mounted to move horizontally along the carriage beam, and wherein the operator cab is mounted to the trolley.

7. The gantry crane of claim 4, further comprising means for moving the operator cab horizontally along the carriage beam.

8. The gantry crane of claim 4, further comprising means for vertically moving the carriage beam with respect to the first side support frame.

9. A gantry crane comprising:

first and second side support frames spaced by at least one beam;

a load lifting mechanism operable to support a load between said first and second side support frames; and an operator cab comprising a door to provide access into an interior of the operator cab, a latch that automatically prevents the door from opening when the operator cab is moved vertically from the lower most position, and controls for moving the load lifting mechanism, wherein the operator cab is selectively moveable either horizontally or vertically in an operational plane defined by the first side support frame.

10. The gantry crane of claim 9, wherein the latch comprises a shaft rotatably mounted to an outside portion of the operator cab, the shaft having an arm on an end of the shaft which, when the shaft rotates, the arm moves to a position across the access door when the operator cab is vertically moved from the lower-most position preventing the access door from being opened.

11. A gantry crane comprising:

a first side support frame having two vertical legs connected by an upper side beam and a lower side beam, the lower side beam having a downwardly-extending portion defining a lowermost position;

a second side support frame having two vertical legs connected to at least one side beam;

at least one beam spacing the first and second side support frames;

a load lifting mechanism operable to support a load between said first and second side support frames; and an operator cab that is vertically moveable generally between the lower side beam and upper side beam of the first side support frame and horizontally movable generally between the two vertical legs of the first side support frame.

12. The gantry crane of claim 11, further comprising a generally horizontal carriage beam disposed generally between the vertical legs of the first side support frame, the operator cab being movably connected to the carriage beam, wherein the carriage beam is vertically movable relative to the legs.

13. The gantry crane of claim 12, further comprising at least two vertical support rails, each of the rails being disposed along a respective one of the legs, wherein opposite ends of the carriage beam are guided vertically along the rails.

14. The gantry crane of claim 11, further comprising a trolley mounted to move horizontally along the carriage beam, and wherein the operator cab is mounted to the trolley.

15. A gantry crane comprising:

a first and second support frames, each said support frame including a pair of vertical legs;

at least one beam extending between the first and second support frames, the one beam and the first and second support frames defining an operating area there between;

a load lifting mechanism operable to support a load between said first and second support frames; and an operator cab including controls for moving the load lifting mechanism, wherein the operator cab is horizontally and vertically movable in a plane defined tangent to the operating area by two of the vertical legs.

16. A gantry crane comprising:

a frame including multiple vertical legs, the frame defining an operating area between said multiple vertical legs;

a load lifting mechanism operable to support a load from the frame;

an operator cab adapted to move relative to the frame and outside of the operating area, the operator cab including controls for moving the load lifting mechanism;

means for vertically moving the operator cab relative to the frame; and means for horizontally moving the operator cab relative to the frame.

17. A gantry crane comprising:

first and second side support frames spaced by at least one beam;

a load lifting mechanism operable to support a load between said first and second side support frames, the load lifting mechanism and the first and second side support frames defining an operating area there between;

an operator cab that is selectively moveable either horizontally or vertically in an operational plane defined by the first side support frame tangent to the operating area; and wherein the first side support frame includes at least two vertical support rails, and wherein a carriage beam connected to the operator cab is guided vertically along the rails.

18. A gantry crane comprising:

first and second side support frames spaced by at least one beam;

a load lifting mechanism operable to support a load between said first and second side support frames; and an operator cab that is selectively moveable either horizontally or vertically in an operational plane defined by the first side support frame, wherein the operator cab comprises a door to provide access into an interior of the operator cab, and a latch that automatically prevents the door from opening when the operator cab is moved vertically from a lower-most position.

19. The gantry crane of claim 18, wherein the latch comprises a shaft rotatably mounted to an outside portion of the operator cab, the shaft having an arm on an end of the shaft which, when the shaft rotates, the arm moves to a position across the access door when the operator cab is vertically moved from the lower-most position preventing the access door from being opened.

20. The gantry crane of claim 1, wherein operator cab includes controls for maneuvering the gantry crane.

* * * * *